US007557282B2

(12) United States Patent
Holdway

(10) Patent No.: US 7,557,282 B2
(45) Date of Patent: Jul. 7, 2009

(54) HARDTAIL CONVERTER BLOCK FOR A TREMOLO EQUIPPED GUITAR

(76) Inventor: David Allan Holdway, P.O. Box 1226, 5 Krista Lane, Cornwall, PE (CA) C0A 1H0

( * ) Notice: Subject to any disclaimer, the term of this patent is extended or adjusted under 35 U.S.C. 154(b) by 38 days.

(21) Appl. No.: 11/711,073

(22) Filed: Feb. 27, 2007

(65) Prior Publication Data

US 2008/0202311 A1 Aug. 28, 2008

(51) Int. Cl.
*G10D 3/00* (2006.01)

(52) U.S. Cl. ..... 84/299; 84/298; 84/313; 84/294

(58) Field of Classification Search ..... 84/313, 84/298, 299, 294
See application file for complete search history.

(56) References Cited

U.S. PATENT DOCUMENTS

| | | | | |
|---|---|---|---|---|
| 2,741,146 | A * | 4/1956 | Fender | 84/313 |
| 4,031,799 | A * | 6/1977 | Fender | 84/307 |
| 4,160,401 | A * | 7/1979 | Tomioka | 84/731 |
| 5,088,375 | A * | 2/1992 | Saijo | 84/313 |
| 5,864,074 | A * | 1/1999 | Hill | 84/313 |
| 6,919,501 | B2 * | 7/2005 | Burton | 84/313 |
| 6,943,284 | B2 * | 9/2005 | Didan | 84/313 |
| 7,145,065 | B2 * | 12/2006 | Geier | 84/313 |
| 2006/0179999 | A1 * | 8/2006 | LaMarra | 84/298 |
| 2008/0011147 | A1 * | 1/2008 | Caldwell et al. | 84/298 |
| 2008/0202311 | A1 * | 8/2008 | Holdway | 84/294 |
| 2008/0271586 | A1 * | 11/2008 | Adams | 84/313 |

OTHER PUBLICATIONS

TailFeather™ Hardtail conversion kit, © 2004, viewed Mar. 27, 2008, http://tailfeather.ballconstoheaven.com/TailFeather.html, http://tailfeather.balloonstoheaven.com/FAQ.html.*

Strat Tremolo to Hardtail Bridge, Forum Nov. 30, 2005, http://acapella.harmony-central.com/showthread.php?t=1098588, viewed Mar. 27, 2008.*

Junk-o-Caster, How to site showing conversion of a Tremolo guitar to a Hardtail guitar, posted Apr. 12 2007., http://www.jjguitarlab.com/?p=51, viewed Mar. 27, 2008.*

Tremolo to Hard tail Conversion, by Brian Calvert, How to prepare a block for the tremolo cavity and do a complete coversion, http://www.projectguitar.com/tut/tht1.htm, http://projectguitar.com/tut/tht2.htm, viewed Mar. 27, 2008.*

Hod Rod Convertible Stratocaster Bridge, bridge covers the vacated tremolo cavity, but does not fill it, viewed Mar. 23, 2009.*

* cited by examiner

*Primary Examiner*—Jeffrey Donels
*Assistant Examiner*—Robert W Horn

(57) ABSTRACT

A converter block for a Stratocaster.®. style tremolo system that effectively changes it to a hardtail configuration. Players who do not use the tremolo can benefit from the ease and stability in tuning, reduced weight, improved tonal characteristics and the reduction in string breakage that this novel design offers.

5 Claims, 3 Drawing Sheets

Fig 3
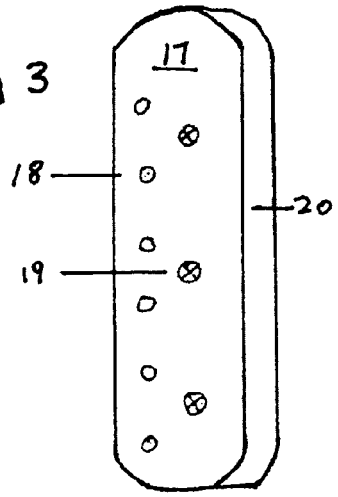
Fig 4
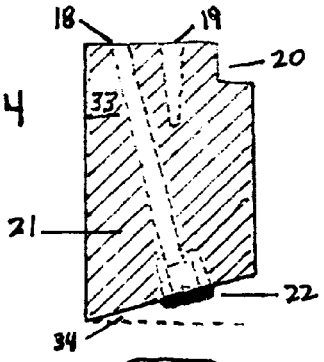
Fig 5
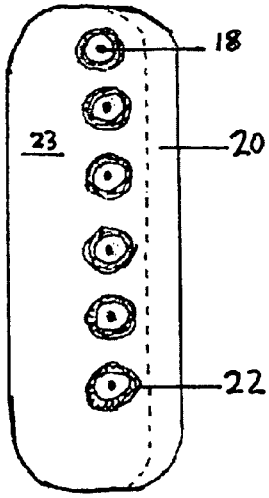
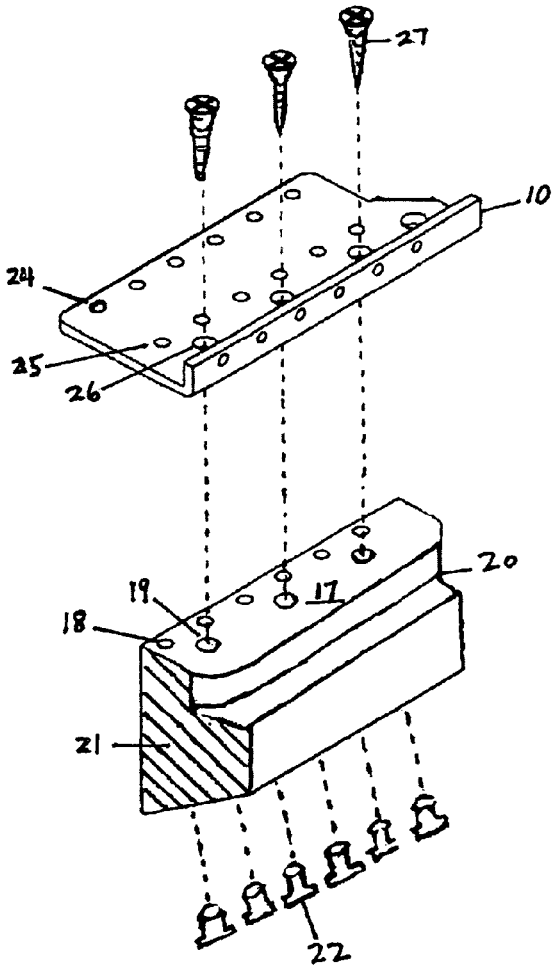
Fig 6

HARDTAIL CONVERTER BLOCK FOR A TREMOLO EQUIPPED GUITAR

BACKGROUND OF THE INVENTION

This invention relates to tremolo devices such as those found on Stratocaster® style guitars and are disclosed in U.S. Pat. No. 2,741,146 issued to C. L. Fender on Apr. 10, 1956. The operation and shortcomings of this design were discussed in U.S. Pat. No. 6,943,284 issued to E. W. Didan on Apr. 14, 2005, and are reproduced here. Some reference numbers have been changed where they refer to the present invention.

"The bridge plate of the tremolo device is situated to pivot on an axis transverse to the direction of the strings. Bridge saddles located on the bridge plate engage the strings to create the intended change in string tension when the player moves the tremolo actuating arm. A counter spring is employed to oppose and counteract the pull of the strings on the bridge plate.

"A problem attendant to the use of such known tremolo devices arises with the breakage of a string. Because the tension of the strings is balanced by the above mentioned counter spring, loss of the force on one or more strings allows the counter spring to displace the bridge plate. This increases the tension on the remaining strings, causing them to go sharp. Thus, the instrument becomes unplayable.

"A second problem attendant to the use of such known tremolo devices arises when tuning. Because the tension of the strings is balanced by the above-mentioned counter-spring, change in force of the string being tuned causes the displacement of the bridge plate. This changes the tension on the remaining strings, causing them to go out of tune. In theory, an instrument with such a bridge can't be tuned. In practice, tuning may only be achieved by repeatedly tuning each successive string until converging on an acceptable tuning of all strings. Thus, the instrument is far more difficult to tune than one with an unmoveable or stabilized bridge.

"Referring now to the drawings in detail, wherein like reference numerals indicate like elements, there is seen in FIG. 1 a guitar designated generally by the reference numeral 1. As is conventional, the guitar 1 consists of a body 2 having a sounding board or face 8. Attached to the body 2 is a neck 3, having a nut 4 and means 5 for a retaining and adjusting the pitch of strings 6.

"A tremolo device, designated generally by the reference numeral 9, is secured to the face 8, and secures the bridge end of the strings 6. Referring now to FIG. 2, the tremolo device 9 includes a bridge plate 10.

"Anchor screws 14 secured to the body 2 provide pivot points for the bridge plate 10. In this regard, referring to FIG. 6 the bridge plate 10 is provided with holes 24, adapted to engage the anchor screws 14. The anchor screws 14 provide a hinge for the bridge plate 10 relative to the face 8.

"Referring now to FIG. 7, associated with the bridge plate 10 is an inertia block 11, which projects downwardly from the bridge plate 10 and extends into a recess 31 in the body 2 of the guitar 1. The strings 6 are secured by an inertia block 11.

"A tremolo actuating arm 16 is secured to the bridge plate 10. Also secured to the bridge plate 10 are bridge saddles 13, which engage the strings 6. Bridge saddles 13 have intonation screws 12 and elevation screws 15 to govern the length and height of each string respectively.

"It will now be seen that movement of the actuating arm 16 causes the bridge plate 10 to pivot relative to the anchor screws 14 and face 8. The bridge 9 causes such movement to vary the tension of all of the strings 6 to produce the desired tremolo effect.

"A counter-spring 28 is provided within recess 31 and coupled in tension to the body 2 and inertia block 11. Means 29 is provided to couple one end of the counter-spring 28 to an anchor screw 30, associated with the body 2.

"The foregoing structure is conventional and is found in the prior art, depicted in FIGS. 2 and 7."

BRIEF SUMMARY OF THE INVENTION

Virtually all Stratocaster.®. style guitars are manufactured with the tremolo device as described above. Many players do not use this device in their playing but are forced to deal with the shortcomings of the design as noted above. The present invention provides a solution to these problems by replacing the metal tremolo block, springs, claw, screws, and actuating arm with a machined hardwood block. The purpose of the block is to completely fill the vertical tremolo cavity and convert the guitar to a hardtail configuration.

The present invention clamps the bridge plate firmly to the body of the guitar, thus eliminating intonation and tuning problems associated with a counterbalanced floating bridge. This clamping is accomplished by a notch on the top rear portion of the present invention interfacing with a routered lip on the upper rear section of the tremolo cavity. As the bridge plate is screwed into the present invention, the routered lip on the rear section of the tremolo cavity is clamped between the bottom of the bridge plate and the notch described above. This clamping action allows any vibration of the bridge plate to be transmitted to the upper body of the guitar for increased resonance.

The present invention has six string holes drilled at an angle of 15 degrees from front to back so that the pull of the strings pulls the back of the block against the rear wall of the tremolo cavity. Any resonance of the bridge plate that is carried through the block is transmitted to the lower body of the guitar and acts in conjunction with the resonance provided by the top of the invention as discussed in [0014] above.

The present invention reduces the possibility of string breakage by having the strings enter the block at an angle of 75 degrees rather than the normal 90 degrees as would be the case with the tremolo bridge block.

The present invention does not require any cutting or drilling to the exterior of the guitar body. It is inserted from the rear of the guitar up into the tremolo cavity and is secured by three one-inch long #6 wood screws using the original bridge plate. The installation is readily reversible if desired.

In addition to the benefits noted above, by replacing the tremolo components below the bridge plate and the actuating arm the weight of the guitar is reduced by 10-15%. This is significant for anyone playing the guitar while standing for extended periods of time.

DESCRIPTION OF THE SEVERAL VIEWS OF THE DRAWING

There is seen in the drawings a form of the present invention which is presently preferred (and which constitutes the best mode contemplated for carrying the invention into effect), but it should be understood that the invention is not limited to the precise arrangement or materials shown.

FIG. 3 is a top non-perspective view of the present invention.

FIG. 4 is a view of FIG. 3 rotated 90 degrees clockwise to show the side view.

FIG. 5 is a view of FIG. 3 rotated 180 degrees clockwise to show the bottom view.

FIG. 6 is an exploded perspective view showing the assembly of the present invention with the original bridge plate.

DETAILED DESCRIPTION OF THE INVENTION

If a player does not use the tremolo when playing, a method of removing the counterbalancing feature of the tremolo bridge is desirable. Referring to FIGS. 3 through 8, a preferred method of accomplishing this is presented.

Figure 8:
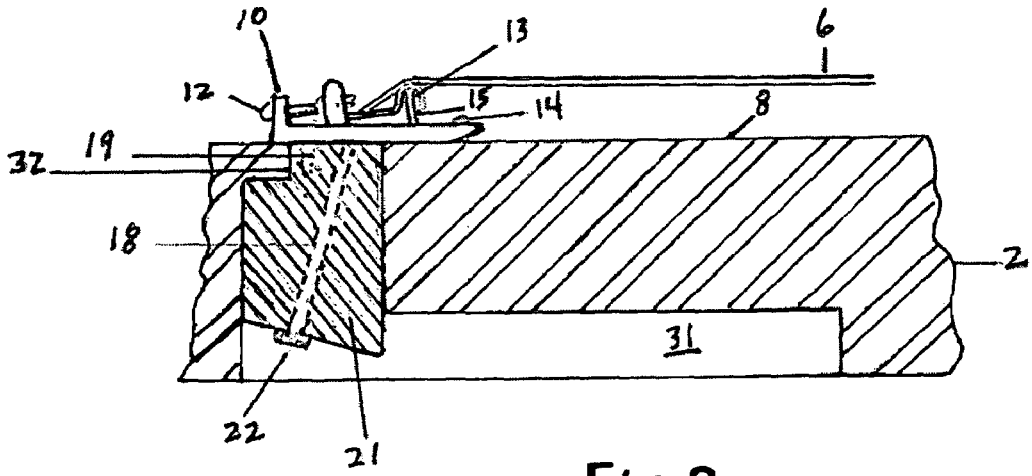
FIG. 8 is a view similar to FIG. 7, taken along the line 7-7 in FIG. 1 showing the present invention in its operative state.

FIG. 3 shows a top view 17 of the present invention, herein after referred to as "the block", and is designed to fit snugly into the routed tremolo cavity of body 2. As presented, it is machined from a piece of clear maple hardwood with the grain running longitudinally from top to bottom and completely fills the vertical portion of the tremolo cavity as shown in FIG. 8 reference 31, including the rounded sections. Maple was used as its tonal qualities are most compatible with the neck, which is usually constructed of maple.

Six one-eighth inch diameter holes 18 are drilled so that they align with holes 25 on the bridge plate 10. Three three-sixteenth inch holes 19 are drilled so that they align with holes 26 in the bridge plate 10.

A notch 20 is cut one-quarter inch deep and one-quarter inch wide on the right-hand side of the top face 17. This notch must interface with the lip 32 on the body 2 as shown in FIG. 8. This lip must be routered so that it is parallel to the top surface 8 of the guitar 2. See FIGS. 7 and 8. The top of the block 17 must be kept one-sixteenth of an inch below the top surface 8 of guitar 2 in order that a clamping action can occur when the base plate 10 is secured to the block 17 using screws 27. This one-sixteenth of an inch gap will be removed as this clamping is preformed.

FIG. 4 shows FIG. 3 rotated 90 degrees clockwise having a cross-section 21. Six holes 18 are drilled at angle 33 of 15 degrees from front to back. This angle of 15 degrees is critical to the performance of the block. A smaller angle will not provide enough pressure on the back of the block against the rear of the tremolo cavity causing a loss of sustain. A larger angle produces too much pressure and causes sustain to be lost. The bottom of the block is also cut at a 15 degree angle 34 from front to back. Holes 18 are counterbored three-eighths of an inch at the bottom to accept industry-standard metal ferrules 22. These ferrules are important in centering the string in the bore. If the strings touch the walls of the bore, sustain will be lost.

FIG. 5 is a view of FIG. 3 rotated 180 degrees clockwise and shows the bottom of the block having a face 23. Holes 18 are counterbored and metal ferrules 22 have been inserted.

FIG. 6 is an exploded perspective view showing the assembly of the block 17 with the original bridge plate 10. The bridge plate 10 is first secured to face 8 of the body 2 using the original screws 14 through holes 24. The block is then pressed into the tremolo cavity 31 of FIG. 8 from the rear until notch 20 intercepts lip 32 of the guitar. At this point, face 17 of the block is one-sixteenth of an inch below the bottom of bridge plate 10.

Screws 27 are then inserted through holes 26 in the bridge plate 10 and screwed down until the bridge plate 10 is flush with face 8 of body 2, and face 17 of the block is flush with the underside of base plate 10.

Figure 1:
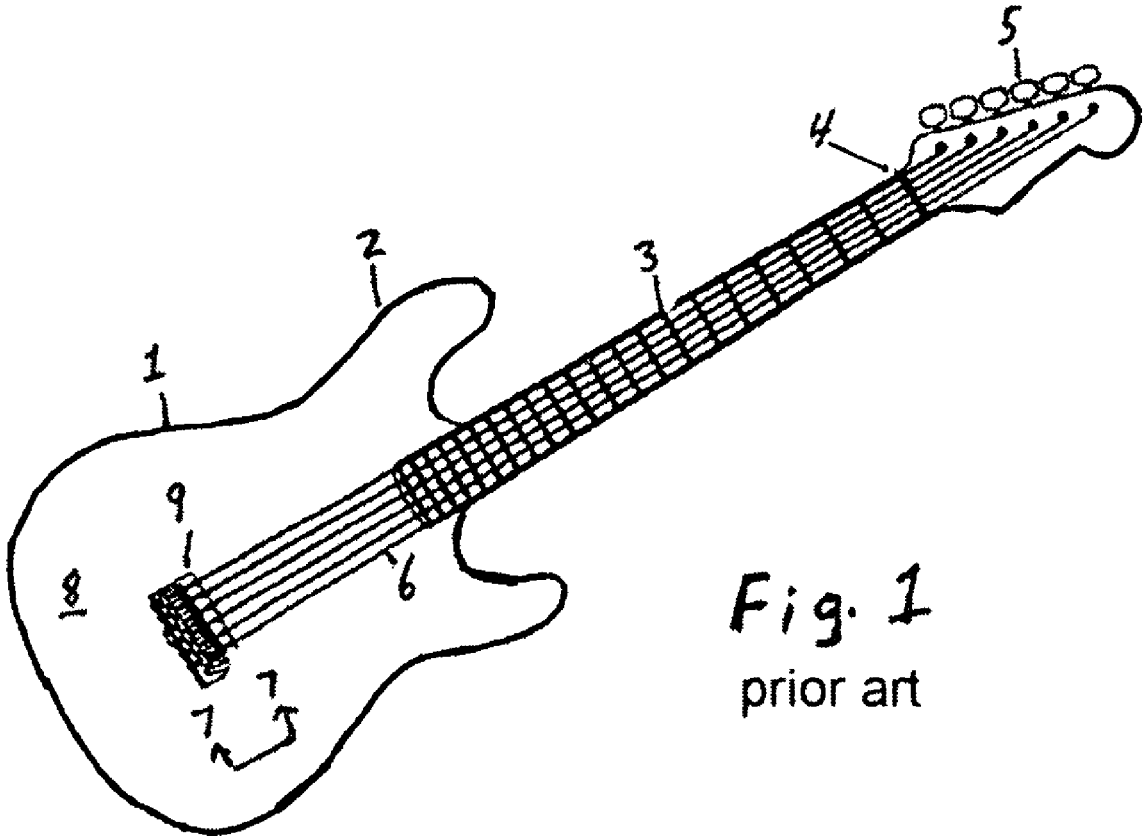
Fig. 1 prior art
FIG. 1 is a pictorial view of a guitar utilizing the present invention.
Figure 2:
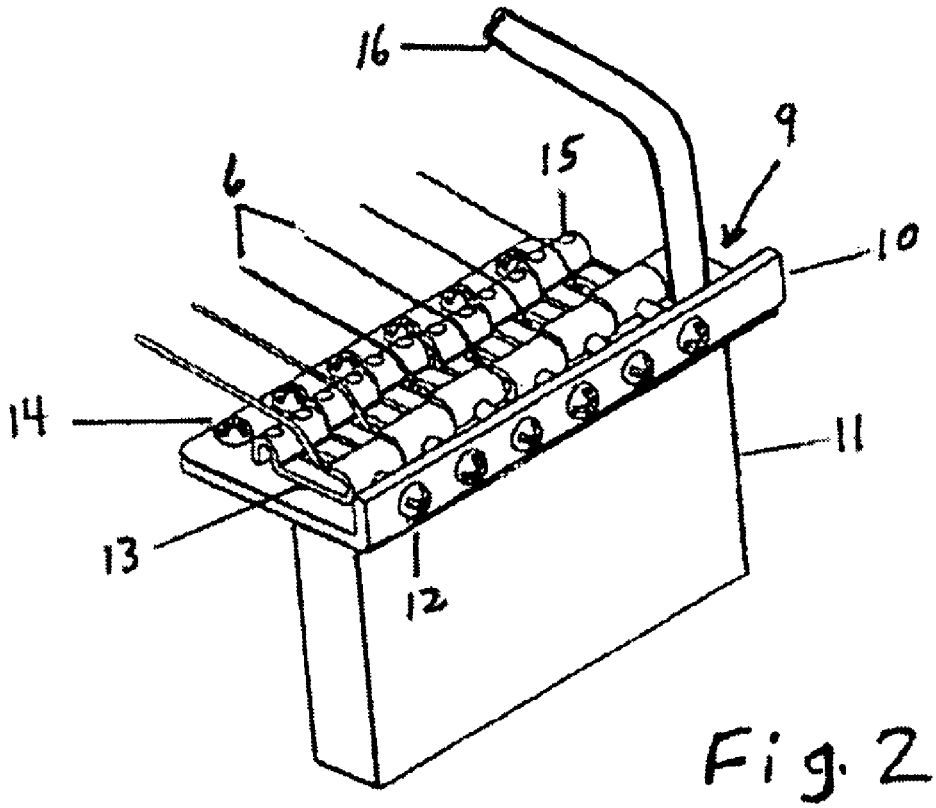
Fig. 2 prior art
FIG. 2 is an enlarged perspective view of a tremolo device.
Figure 7:
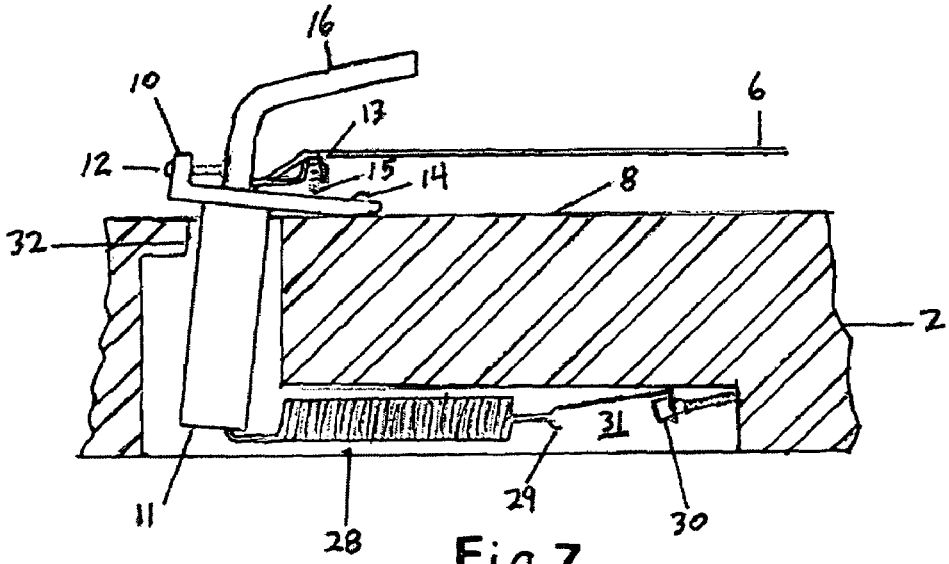
Fig 7 prior art
FIG. 7 is a partial cross-sectional view along sight-line 7 in FIG. 1 showing a tremolo device in an operative condition.

FIG. 7 shows a partial cross-section view of a typical tremolo bridge in its normal operating position as viewed at angle 7 in FIG. 1 and has been described in the section "Background of the Invention."

FIG. 8 is a modified version of FIG. 7 showing the block in its installed position. The original tremolo block 11, springs 28, claw 29, retaining screws 30, and actuating arm 16 have all been removed. Lip 32 has been routered so that its face is parallel to face 8.

Each of the six strings 6 are inserted through holes in the ferrules 22, up through holes 18, then through the bridge plate holes 25 and over saddles 13. They are terminated at the tuners 5. The other end of the strings 6 have a metal ball or nut that is retained in the ferrules 22, allowing the strings to be tuned.

No drilling or cutting of the guitar body 2 exterior is required to use the block and the guitar can easily be returned to its original setup if desired.

The present invention provides a means of overcoming the instability problems associated with a counterbalanced tremolo bridge and represents a viable option for players who do not use a tremolo. They also have the benefit of increased sustain provided by the interaction of the clamping action on lip 32 and the pressure provided to the lower portion of the block by the 15 degree string offset 18.

The present invention may be used in other forms without departing from its essential attributes. Reference should be made to the claims rather than the above specification in determining the scope of the present invention.

I claim:

1. A replacement block for the metal tremolo block as used on a Stratocaster.TM styled guitar providing a body with a tremolo mechanism in a tremolo cavity, comprising:

the guitar with the original tremolo mechanism completely removed from the tremolo cavity;

the guitar tremolo cavity modified to form a squared off lip at the top rear section;

a block shape that completely fills the original vertical portion of the tremolo cavity;

the block having a notch cut in the top rear section to accommodate the lip at the top rear section of the guitar's tremolo cavity;

a string bridge;

fasteners;

wherein the fasteners pass through the string bridge and into the block to press the block into the tremolo cavity when the fasteners are tightened; and the combination transforming the guitar into a hardtail configuration.

2. A block in accordance with claim 1 having 6 holes drilled into the block at an angle to the body of the guitar.

3. A block in accordance with claim 2 having 6 metal ferrules provided in the holes in the bottom of the block to retain the strings.

4. A block in accordance with claim 2 in which the strings enter the block at a reduced angle of less than 90 degrees.

5. A block in accordance with claim 1, comprising a light weight material which reduces the weight of the guitar converted to the hardtail configuration.

* * * * *